US008773235B2

(12) United States Patent
Bohori et al.

(10) Patent No.: US 8,773,235 B2
(45) Date of Patent: Jul. 8, 2014

(54) ELECTRICAL SWITCH AND CIRCUIT BREAKER

(71) Applicant: General Electric Company, Schenectady, NY (US)

(72) Inventors: Adnan Kutubuddin Bohori, Bangalore (IN); Mohandas Nayak, Bangalore (IN); Sundeep Kumar, Bangalore (IN); Padmaja Parakala, Bangalore (IN); Sudhakar Eddula Reddy, Bangalore (IN)

(73) Assignee: General Electric Company, Schenectady, NY (US)

( * ) Notice: Subject to any disclaimer, the term of this patent is extended or adjusted under 35 U.S.C. 154(b) by 12 days.

(21) Appl. No.: 13/677,905

(22) Filed: Nov. 15, 2012

(65) Prior Publication Data

US 2013/0134028 A1 May 30, 2013

(30) Foreign Application Priority Data

Nov. 30, 2011 (IN) ..... 4132/CHE/2011

(51) Int. Cl.

| | |
|---|---|
| ***H01C 10/36*** | (2006.01) |
| ***H01C 13/02*** | (2006.01) |
| ***H01C 7/18*** | (2006.01) |
| ***H01H 15/04*** | (2006.01) |
| ***H01H 9/42*** | (2006.01) |
| ***H01H 13/78*** | (2006.01) |

(52) U.S. Cl.

CPC ..... *H01C 13/02* (2013.01); *H01C 10/36* (2013.01); *H01C 7/18* (2013.01); *H01H 15/04* (2013.01); *H01H 9/42* (2013.01); *H01H 13/78* (2013.01)

USPC ..... 338/172; 338/162; 338/167; 338/170

(58) Field of Classification Search

CPC ..... H01C 10/36; H01C 10/38; H01H 15/04; H01H 9/42; H01H 13/02; H01H 13/12; H01H 13/78; H01H 13/79; H01H 1/365; H01H 2083/205; H01H 2203/054; H01H 2221/004; H01H 2225/01; H01H 2225/022; H01H 35/2614; H01H 3/20; H01H 71/0221

USPC ..... 338/162, 167, 170, 172

See application file for complete search history.

(56) References Cited

U.S. PATENT DOCUMENTS

| | | | |
|---|---|---|---|
| 1,595,061 | A | 10/1923 | Vaiebitts et al. |
| 2,956,255 | A | 10/1960 | Ragnvald |

(Continued)

FOREIGN PATENT DOCUMENTS

| | | | |
|---|---|---|---|
| DE | 3147260 | A1 | 6/1983 |
| EP | 0517618 | A1 | 12/1992 |
| FR | 2581790 | A1 | 11/1986 |

OTHER PUBLICATIONS

Search Report and Written Opinion from corresponding EP Application No. 12194872.3 dated Mar. 27, 2013.

(Continued)

*Primary Examiner* — Kyung Lee

(74) *Attorney, Agent, or Firm* — Global Patent Operation; Stephen G. Midgley

(57) ABSTRACT

An electrical switch and a circuit breaker are presented herein. The electrical switch includes a graded resistance block comprising a first end having a first electrical resistivity and a second end having an electrical resistivity greater than the first electrical resistivity. The electrical switch further includes a fixed contact electrically coupled to the first end of the graded resistance block, and a sliding contact configured to slide over the graded resistance block. In addition to the components of the electrical switch, the circuit breaker also includes a forcing mechanism to slide the sliding contact over the graded resistance block from the first end to the second end.

24 Claims, 7 Drawing Sheets

(56) References Cited

U.S. PATENT DOCUMENTS

| | | | |
|---|---|---|---|
| 3,991,396 | A | 11/1976 | Barkan |
| 4,429,295 | A | 1/1984 | Wu |
| 5,193,041 | A | 3/1993 | Chanois |
| 5,581,192 | A | 12/1996 | Shea et al. |
| 6,850,145 | B1 | 2/2005 | Kremers et al. |
| 7,139,158 | B2 | 11/2006 | Niayesh et al. |
| 2004/0051605 | A1 | 3/2004 | Fasano |
| 2005/0219775 | A1 | 10/2005 | Shipp et al. |
| 2005/0286195 | A1 | 12/2005 | Francis |
| 2010/0053833 | A1 | 3/2010 | Weiher et al. |
| 2010/0072174 | A1 | 3/2010 | Asokan et al. |
| 2010/0219163 | A1 | 9/2010 | Holaus et al. |
| 2010/0308943 | A1 | 12/2010 | Dobusch |
| 2010/0321836 | A1 | 12/2010 | Dvorak et al. |
| 2011/0096444 | A1 | 4/2011 | Wright et al. |

OTHER PUBLICATIONS

Jadidian et al.,"A Compact Design for High Voltage Direct Current Circuit Breaker", Plasma Science, IEEE Transactions, ISSN : 0093-3813, vol. 37, Issue:6, On pp. 1084-1091, References Cited: 16, Issue Date : Jun. 2009.

ELECTRICAL SWITCH AND CIRCUIT BREAKER

BACKGROUND

Embodiments presented herein relate generally to electrical switchgear, and more particularly to arcless electrical switchgear.

A circuit breaker is an apparatus used to break the circuit when the current in the circuit exceeds a predefined limit. Conventional circuit breakers may produce an electrical arc when the electrical contacts open in response to a fault condition. Electrical arcing is undesirable, especially in hazardous environments where there is a danger of fires.

Some known solutions to extinguish arcing employ arc runners, arc chutes, ablative cooling, and so forth. The time taken in extinguishing the arc is very high, even greater than the contact opening time. Moreover, the arc is eliminated at natural current zero instance which occurs in AC circuit breaker. DC circuit breakers do not exhibit a natural current zero instance. Therefore, additional circuitry and arrangements are required to force a current zero instance.

One known solution utilizes a conductive liquid composition disposed in a flexible tube between the two metal contacts. During normal operating conditions, the conductive liquid composition provides low resistivity. However, when a fault condition occurs, the flexible tube is squeezed to reduce the cross section area of the tube, thus increasing the resistivity between the two metal contacts. Such an increase in the resistivity effectively creates an open circuit condition. However, such switchgear may be limited by the steady state resistivity of the conductive liquid composition. For example, due to the high conductivity of conductive liquid composition, the current conduction area may need to be reduced to 10e-6 square meter. Such a constriction may be exceedingly difficult to achieve. Further, the need for such constriction, coupled with high switching speed may warrant the use of exotic materials to produce a durable flexible tube.

Therefore, there is a need in the art for switchgear that overcomes these and other shortcomings associated with known solutions.

BRIEF DESCRIPTION

According to one embodiment, an electrical switch is disclosed. The electrical switch includes a graded resistance block comprising a first end having a first electrical resistivity and a second end having an electrical resistivity greater than the first electrical resistivity. The electrical switch further includes a fixed contact electrically coupled to the first end of the graded resistance block, and a sliding contact configured to slide over the graded resistance block. The circuit breaker also includes a forcing mechanism to slide the sliding contact over the graded resistance block from the first end to the second end.

According to one embodiment, an electrical switch is disclosed. The electrical switch includes a graded resistance block comprising a first end having a first electrical resistivity and a second end having an electrical resistivity greater than the first electrical resistivity. The graded resistance block is slidably coupled to a first contact. The circuit breaker further includes a second contact electrically coupled to the first end of the graded resistance block. The electrical switch also includes a forcing mechanism to slide the graded resistance block across the first contact such that a current path between the first and second contacts transitions from a conducting state to a non-conducting state.

According to one embodiment, an electrical switch is disclosed. The electrical switch includes a graded resistance block comprising a first end having a first electrical resistivity and a second end having an electrical resistivity greater than the first electrical resistivity. The electrical switch further includes a first sliding contact configured to slide over the graded resistance block, and a second sliding contact configured to slide over the graded resistance block. The first sliding contact and the second sliding contact may be configured to contact the graded resistance block at a predetermined separation, the predetermined separation being measured in a direction of motion of the first sliding contact and the second sliding contact.

DRAWINGS

DETAILED DESCRIPTION

Embodiments presented herein describe electrical switches and circuit breakers. In conventional electrical switches and circuit breakers, the transition from a closed circuit position to an open circuit position is typically abrupt, and the current flow between the contacts ceases abruptly. Such abrupt interruption may cause electrical arcing during a switching operation. Embodiments presented herein describe electrical switches and circuit breakers that employ a graded resistance block to provide a smooth increase in resistance while switching from closed circuit (zero resistance) to open circuit (infinite resistance). The graded resistance block introduces a series resistance in a graduated manner, thus reducing current between the two contacts gradually and substantially reducing electric arcing. Although embodiments presented herein have been described in conjunction with particular electrical switches and circuit breakers, it should be noted that such teachings may apply equally to other types of electrical switchgear as well.

Figure 1:
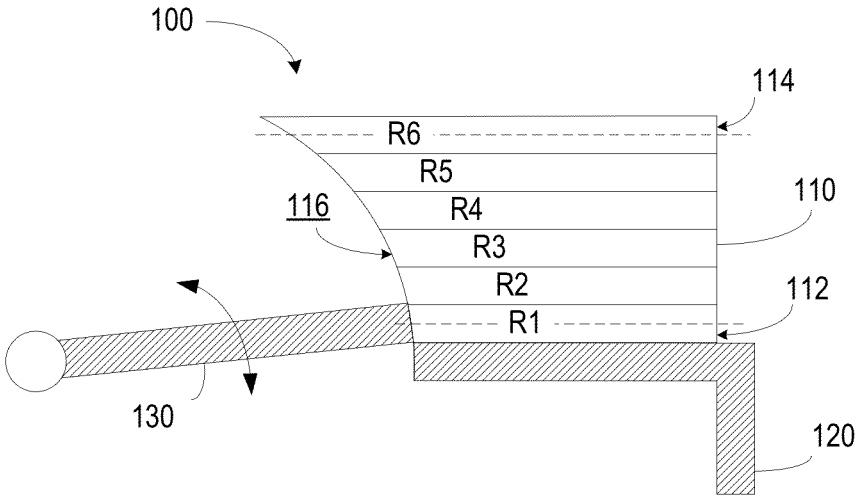
FIG. 1 illustrates a simplified schematic of an electrical switch, according to one embodiment.

FIG. 1 is a simplified schematic of an example electrical switch 100 according to one embodiment. The electrical switch 100 includes a graded resistance block 110, a fixed contact 120 and a sliding contact 130. The graded resistance block 110 has an electrical resistivity graded along the length of the graded resistance block 110. The graded resistance block 110 includes ends 112 and 114, having a first electrical resistivity and a second electrical resistivity respectively. The electrical resistivity at the end 114 is up to 12 orders of magnitude greater than the electrical resistivity at end 112. For instance, the electrical resistivity at the end 112 may be 100 micro ohm meter, and at the end 114 may be 1 ohm meter. Alternatively, the electrical resistivity at the end 114 may be over 12 orders of magnitude greater than the electrical resistivity at end 112. The electrical resistivity of the graded resistance block 110 may be graded from the first electrical resistivity to the second electrical resistivity as a continuous function of distance from either end (i.e. end 112 or end 114), or in discrete steps.

In one embodiment, the graded resistance block 110 comprises a plurality of discrete resistance cassettes stacked in order of electrical resistivity of the discrete resistance cassettes. FIG. 1 depicts a stacked arrangement of multiple resistance cassettes of distinct electrical resistivities, shown as R1, R2, R3, R4, R5 and R6. The resistance cassettes are arranged in an ascending order such that the resistance cassette R1 has the lowest electrical resistivity and the resistance cassette R6 has the highest electrical resistivity. Part or the entirety of the resistance cassette R1 may form the end 112, and part or the entirety of the resistance cassette R6 may form the end 114. Typically, before stacking, the interfacing surfaces of the resistance cassettes may be machined to the required roughness. The discrete resistance cassettes (R1, R2, R3, R4, R5 and R6) may be bonded to each other using suitable techniques such as adhesive bonding, brazing, or soldering, for example. Alternatively, the discrete resistance cassettes (R1, R2, R3, R4, R5 and R6) may be mechanically clamped together using a clamp assembly, under a predefined clamping pressure. In one such clamping implementation, an electrically conductive compound may be applied to the interfacing surfaces of the resistance cassettes (R1, R2, R3, R4, R5 and R6). The electrically conductive compound may be, for example, an electrical jointing paste. The electrically conductive compound may reduce any air gap between the two surfaces, and maintain the required electrical conductivity between the resistance cassettes. In one embodiment, the resistance cassettes have a thickness substantially equal to the thickness of a sliding contact 130. Such dimensions of the resistance cassettes may provide a uniform transition of resistivity in response to the motion of the sliding contact 130.

In another embodiment, the graded resistance block 110 may be a monolithic cassette structure. The monolithic cassette may exhibit a continuous grain structure. One example monolithic cassette includes a cermet monolithic cassette. The monolithic cassette may be made of a ceramic material such as, but not limited to, zinc oxide, aluminum oxide, aluminum nitride, boron nitride, silicon dioxide, indium tin oxide, and combinations thereof; and an electrically conductive material such as, but not limited to, silver, copper, gold, aluminum, indium, tin, gallium, nickel, titanium, zinc, lead, carbon, iron, tungsten, molybdenum, alloys thereof, and mixtures thereof. Cermet monolithic cassettes may provide a graded electrical resistivity varying by up to twelve orders of magnitude, for example, from 10-100 micro Ohm meter to 1-10 Ohm meter.

In yet another embodiment, the graded resistance block 110 includes a cassette made of conjugated polymers. The conjugated polymers comprise conducting polymers in a conjugated system. Conducting polymers are organic polymers that exhibit high electrical conductivity. Polymers with metallic conductivity and semi-conductivity may be used. The conjugated polymers may combine the processability and mechanical characteristics of polymers with the customizable electrical properties of functional organic molecules. The electronic characteristics of these materials are primarily governed by the nature of the molecular conjugation, but intermolecular interactions also exert a significant influence on the macroscopic materials properties. An example conjugated polymer resistance block 110 includes trans-polyacetylene (t-PA), polythiophene (PT) and polypyrrole (PPY). The electrical conductivity of such conjugated polymers may be varied according to doping level.

The graded resistance block 110 may be selected such that the graded resistance block 110 is chemically stable in the operating environment. The graded resistance block 110 may be selected to have a hardness greater than 3 on the Mohs scale to ensure abrasion resistance through the rated lifetime of the switch 100. Other characteristics may include thermal stability of more than 300 degrees. The higher the thermal stability of the block unit, the higher is the resistance to decompose at higher temperatures.

The fixed contact 120 is electrically coupled to the end 112. The fixed contact 120 may be coupled to the longitudinal face of the graded resistance block 110 at the end 112. Alternatively, the fixed contact 120 may be coupled to one or more side faces of the graded resistance block 110 at the end 112. The fixed contact 120 may be made of metals such as, but not limited to, copper, brass, steel, and so forth. The material for the fixed contact 120 may be chosen based on electrical conductivity, hardness or abrasion resistance, mechanical strength, cost, and so forth. Depending on the material of the graded resistance block 110, a suitable bonding process, for example, adhesive bonding, soldering, brazing, and so forth may be chosen to bond the fixed contact 120 to the end 112 of the graded resistance block 110. In some embodiments, the fixed contact 120 may be positioned in contact with the end 112 using for example, a spring assembly. The spring assembly may be configured to maintain a predefined contact pressure between the fixed contact 120 and the end 112. The spring assembly may be any suitable assembly including, without limitation, coil springs, leaf springs, pneumatic springs, and so forth. In one such embodiment, an electrical conductive compound, such as an electrical jointing paste may be applied to the interfacing surfaces of fixed contact 120 and the end 112 of graded resistance block 110. The electrical conductive compound may be chosen such that the paste substantially reduces or eliminates altogether galvanic corrosion of the fixed contact 120 and the end 112, while maintaining the required electrical conductivity between the fixed contact 120 and the end 112.

The sliding contact 130 is configured to slide over the graded resistance block 110. The sliding contact 130 may slide over a sliding surface 116 of the graded resistance block 110. The sliding surface 116 of the graded resistance block may be an arc shaped surface, however, other implementations are contemplated. In such an arc shaped implementation, the sliding contact 130 may be disposed on a rotary assembly configured to slide the sliding contact 130 along the arc shaped sliding surface 116.

A suitable forcing mechanism (not shown) may be coupled to the sliding contact 130. The forcing mechanism is configured to slide the sliding contact 130 over the graded resistance block 110 across the sliding surface 116. The forcing mechanism may be a spring actuated mechanism. Alternatively, the forcing mechanism may be a manually operated mechanism, such as, but not limited to, a plunger mechanism, a lever mechanism, and so forth.

Figure 2:
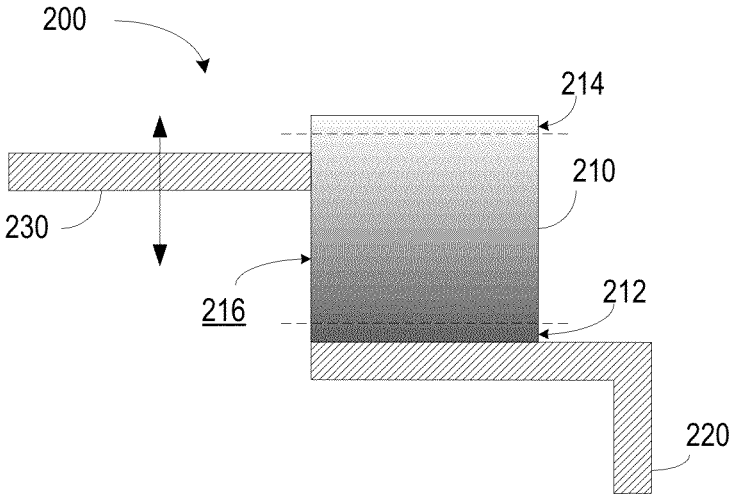
FIG. 2 illustrates a simplified schematic of an electrical switch, according to another embodiment.

FIG. 2 is a simplified schematic of an example electrical switch 200 according to another embodiment. The electrical switch 200 includes a graded resistance block 210, a fixed contact 220 and a sliding contact 230. The graded resistance block 210 has an electrical resistivity graded along the length of the graded resistance block 210. The graded resistance block 210 includes ends 212 and 214, having a first electrical resistivity and a second electrical resistivity respectively. The electrical resistivity at the end 214 is up to 12 orders of magnitude greater than the electrical resistivity at end 212. For instance, the electrical resistivity at the end 212 may be 1 micro ohm meter, and at the end 214 may be 1 ohm meter. Alternatively, the electrical resistivity at the end 214 may be over 12 orders of magnitude greater than the electrical resistivity at end 212. The electrical resistivity of the graded resistance block 210 may be graded from the first electrical resistivity to the second electrical resistivity as a continuous function of distance from either end (i.e. end 212 or end 214), or in discrete steps. The sliding contact 230 is configured to slide over the graded resistance block 210. The sliding contact 230 may slide over a sliding surface 216 of the graded resistance block 210. The sliding surface 216 of the graded resistance block may be a planar surface. In such an implementation, the sliding contact 230 may be disposed on a translating assembly configured to slide the sliding contact 230 along the planar sliding surface 216. The operation and construction of various aspects of the electrical switch 200 is similar to those described in conjunction with FIG. 1 above.

A suitable forcing mechanism (not shown) may be coupled to the sliding contact 230. The forcing mechanism is configured to slide the sliding contact 230 over the graded resistance block 210 across the sliding surface 216. The forcing mechanism may be a spring actuated mechanism. Alternatively, the forcing mechanism may be a manually operated mechanism, such as, but not limited to, a plunger mechanism, a lever mechanism, and so forth.

Although FIG. 1 and FIG. 2 illustrate two possible embodiments of an electrical switch employing a graded resistance block, other embodiments are also envisioned. For example, the graded resistance block may be constructed in other shapes, such as a cylinder, having electrical resistivity graded along the length of the cylinder. The sliding contact may be configured to slide on the outer curved surface of the cylindrical graded resistance block. Alternatively, the graded resistance block may be in the form of a hollow cylinder, and the sliding contact may be configured to slide along the internal curved surface of the hollow cylinder. The longitudinal ends of the cylinder may represent the ends of the graded resistance block. The sliding contact may be disposed on any suitable assembly to maintain a predefined contact pressure with the graded resistance block. Alternatively, a plurality of graded resistance blocks, shaped as longitudinal sections of a cylinder, and disposed radially about an axis may be used. The sliding contact may be a circular disc sliding along the inside of the longitudinal sections, along the axis. Alternatively, the sliding contact may be an annular ring sliding along the outside of the longitudinal sections. In such implementations, the graded resistance block(s) may be disposed on a suitable spring assembly to maintain the predefined contact pressure with the sliding contact.

Embodiments presented above illustrate electrical switches. The embodiments may also be employed as a single use current limiting device that may be deployed in series with conventional switch gear. Such single use current limiting devices may find use in, for example, heavy electrical installations such as factories, the electrical distribution grid, and so forth. The electrical switches may also be a part of a circuit breaker capable of arcless current interruption. In order to trip the circuit breaker during a fault condition, a forcing mechanism is employed in the electrical switch to move the sliding contact over the graded resistance block. The forcing mechanism may be designed to provide either a rotational motion or a translation motion to the sliding contact with respect to the graded resistance block, based on the construction of the graded resistance block and the electrical switch.

A rotary forcing mechanism may include a rotary actuator, a latch and a pivot/hinge joint and configured to provide a rotational motion to the sliding contact. The rotary actuator may be mechanical, such as spring actuated, or pneumatically actuated. During normal operating condition, the sliding contact is held in contact with a conductive end of the graded resistance block (for example, end 112 or 212). The rotary actuator may be held by the latch in such a closed circuit position. During a fault condition, a trip mechanism may release the latch, thus releasing the rotary actuator and forcing the sliding contact from the conductive end to a resistive end (for example, end 114, or 214) and trips the circuit breaker to open circuit position. The forcing mechanism may provide a sliding contact speed in the range of 1-10 meter per second (m/s).

A translational forcing mechanism may include a translational actuator, a latch and guide grooves, and may be configured to provide a translational motion to the sliding contact. The translational actuator may be mechanical, such as spring actuated, or pneumatically actuated. During normal operating condition, the sliding contact is held in contact with a conductive end of the graded resistance block (for example, end 112 or 212). The translational actuator may be held by the latch in such a closed circuit position. During a fault condition, a trip mechanism may release the latch, thus releasing the translational actuator and forcing the sliding contact from the conductive end to a resistive end (for example, end 114, or 214) and trips the circuit breaker to open circuit position. The forcing mechanism may provide a sliding contact speed in the range of 1-10 meter per second (m/s).

It should be appreciated that while a rotary and a translational forcing mechanism have been described herein, other forcing mechanisms that may be a combination of rotary and translational motion are also envisioned, within the scope of the present disclosure.

Figure 3A:
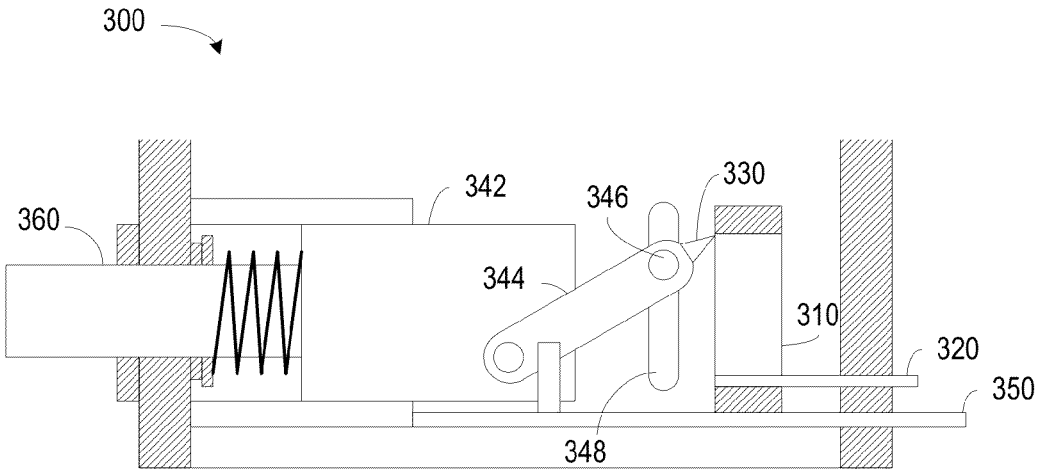
FIGS. 3A and 3B illustrate an example circuit breaker assembly, according to one embodiment.
Figure 3B:
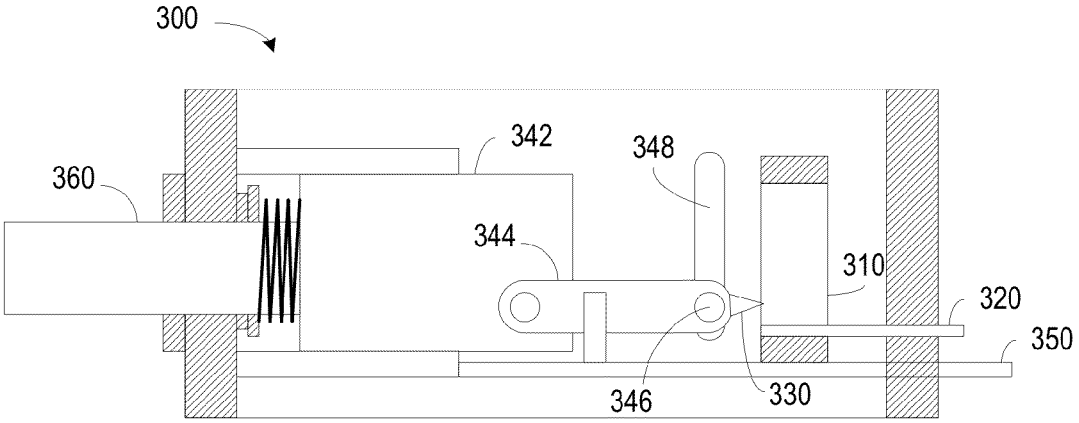

FIGS. 3A and 3B illustrate an example circuit breaker 300, according to one embodiment. The circuit breaker 300 includes a graded resistance block 310, a fixed contact 320, a sliding contact 330, and a forcing mechanism. The forcing mechanism includes a plunger 342, a rotary sweep arm 344 pivotally coupled to the plunger 342, a guide pin 346 disposed on the rotary sweep arm 344, and a guide 348 within which the guide pin 346 moves. The forcing mechanism also includes a reverse current loop 350 to force the circuit breaker 300 from a closed circuit position to an open circuit position during fault condition. The circuit breaker 300 also includes a reset bar 360, to reset the circuit breaker 300 after it has been tripped by a fault condition. Pulling out the reset bar 360 in a direction away from the graded resistance block 310, for example, may reset a tripped circuit breaker 300. The plunger 342 may provide a high inertia system for the forcing mechanism, such that chatter or contact bounce between the sliding contact 330, and the graded resistance block 310 is at least substantially reduced. FIG. 3A illustrates the open circuit position of the circuit breaker 300, while FIG. 3B illustrates the closed circuit position of the circuit breaker.

Figure 4:
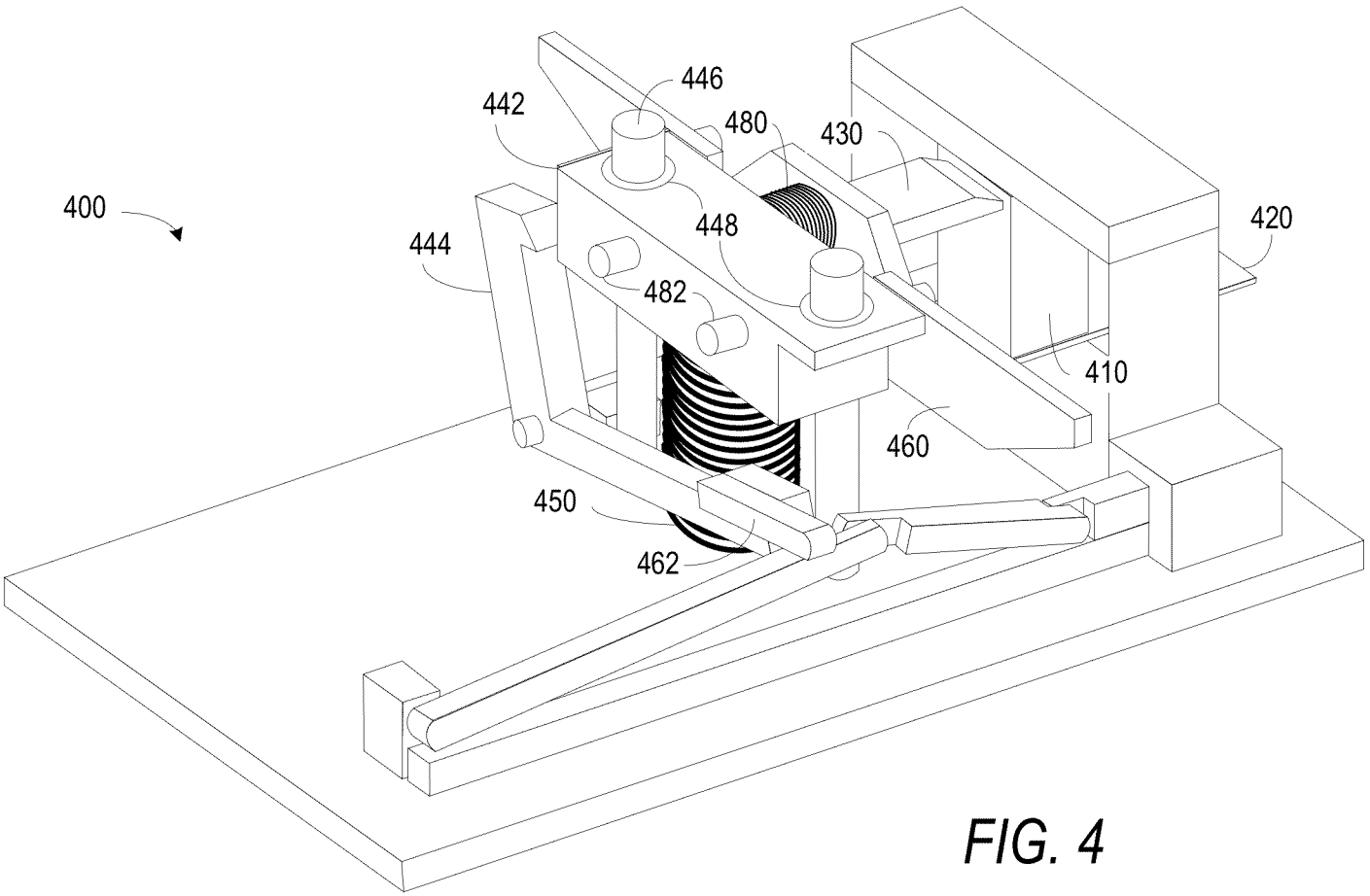
FIG. 4 illustrates an example circuit breaker assembly, according to another embodiment.

FIG. 4 illustrates an example circuit breaker 400, according to one embodiment. The circuit breaker 400 includes a graded resistance block 410, a fixed contact 420, a sliding contact 430, and a forcing mechanism. The forcing mechanism includes a damping block 442, a latch 444 that holds the damping block 442 in the closed circuit position, guide pins 446 disposed on the housing, and corresponding guides 448 on the damping block 442, by which the damping block 442 moves along the guide pins 446. The forcing mechanism also includes a shut-off spring 450 to force the circuit breaker 400 from a closed circuit position to an open circuit position. The circuit breaker 400 also includes a reset bar 460, to reset the circuit breaker 400 after it has been tripped by a fault condition. Pushing down the reset bar 460 may reset a tripped circuit breaker 400. The circuit breaker 400 may also include a manual trip arm 462. Applying an upward force to the manual trip arm 462 manually trips the circuit breaker 400. The damping block 442 may provide a high inertia system for the shut-off spring 450, such that chatter or contact bounce between the sliding contact 430, and the graded resistance block 410 is at least substantially reduced. The circuit breaker 400 further includes a contact pressure spring 480. Contact pressure adjustment screws 482 may also be provided to adjust the compression of the contact pressure spring 480 and thereby control the force applied between the sliding contact 430 and the graded resistance block 410.

Figure 5:
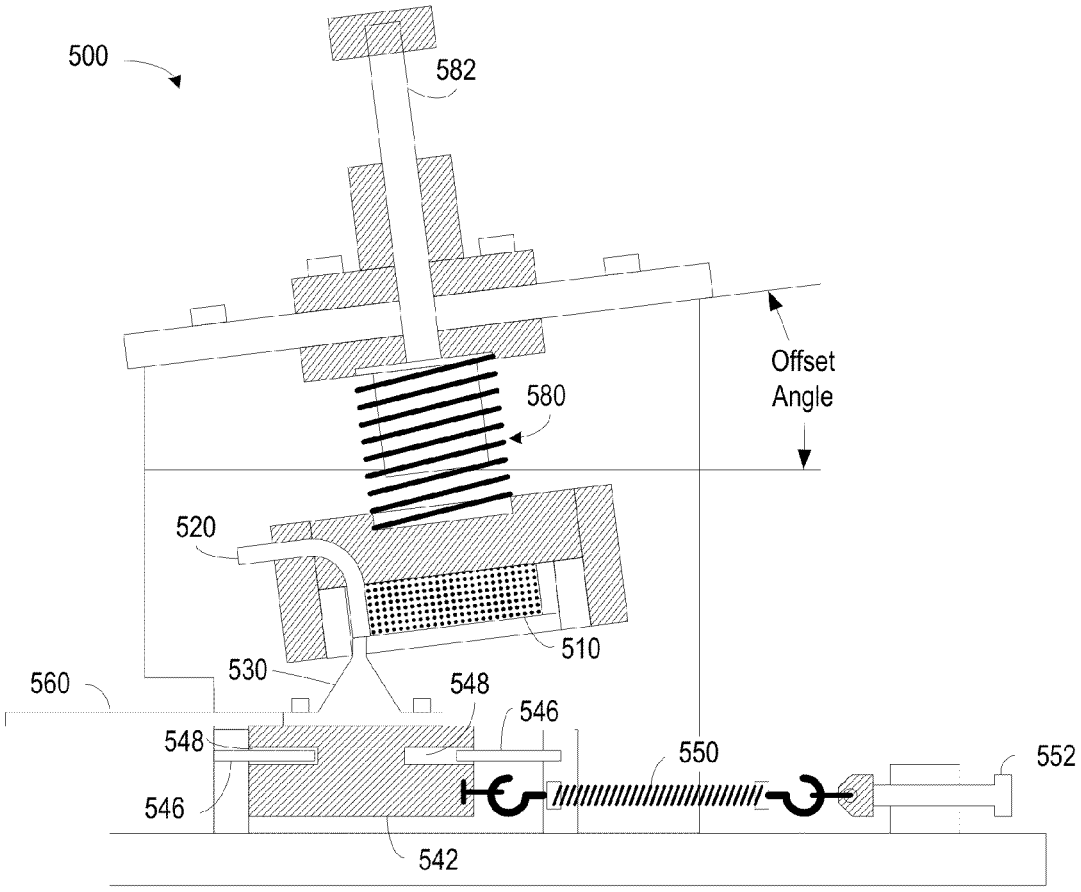
FIG. 5 illustrates an example circuit breaker assembly, according to another embodiment.

FIG. 5 illustrates an example circuit breaker 500, according to one embodiment. The circuit breaker 500 includes a graded resistance block 510, a fixed contact 520, a sliding contact 530, and a forcing mechanism. The forcing mechanism includes a damping block 542, a guide pin 546 disposed on the damping block 542, and a guide 548 on the damping block 542, within which the guide pin 546 moves. The forcing mechanism also includes a shut-off spring 550 to force the circuit breaker 500 from a closed circuit position to an open circuit position. The circuit breaker 500 also includes a reset bar 560, to reset the circuit breaker 500 after it has been tripped by a fault condition. A force adjustment screw 552 may be provided to adjust the tension of the shut-off spring 550. Pulling the reset bar 560 may reset a tripped circuit breaker 500. The damping block 542 may provide a high inertia system for the shut-off spring 550, such that chatter or contact bounce between the sliding contact 530, and the graded resistance block 510 is at least substantially reduced. The circuit breaker 500 further includes a contact pressure spring 580 to urge the graded resistance block 510 toward the sliding contact 530. A contact pressure adjustment screw 582 may also be provided to adjust the compression of the contact pressure spring 580.

The graded resistance block 510 may be mounted in the housing of the circuit breaker 500 at an angular offset in relation to the plane of motion of the sliding contact 530. In one embodiment, the angular offset may be of, 5 degrees, for example. Such an angular offset may provide a constant and even contact pressure between the graded resistance block 510, and the sliding contact 530. This may result in further reduction of contact bounce or chatter while the circuit breaker 500 trips.

Figure 6:
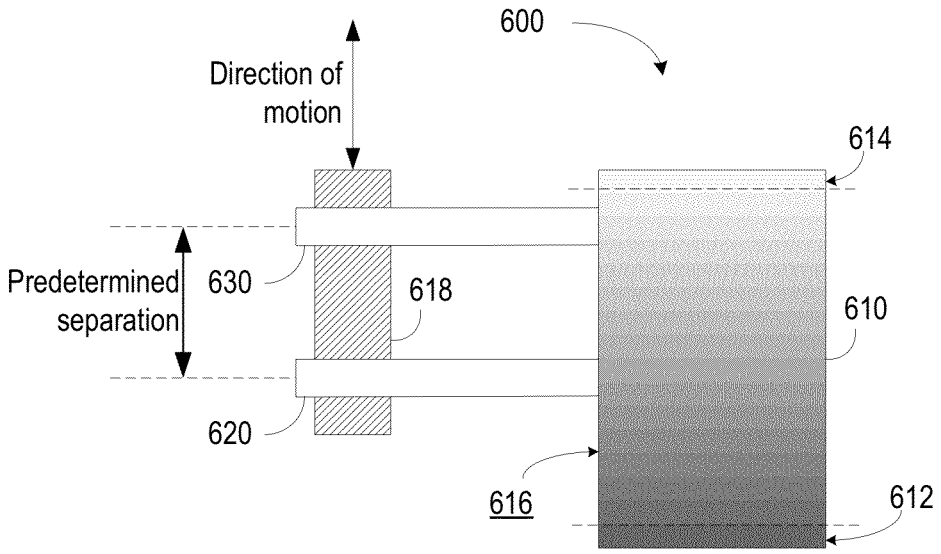
FIG. 6 illustrates a simplified schematic of an electrical switch, according to another embodiment.

Embodiments described thus far include a fixed contact, and a sliding contact. In some embodiments, an electrical switch may include two sliding contacts. FIG. 6 illustrates a simplified schematic of an electrical switch 600, according to one embodiment. The electrical switch 600 includes a graded resistance block 610, a first sliding contact 620, and a second sliding contact 630. The sliding contacts 620 and 630 are configured to slide on the sliding surface 616 of the graded resistance block 610.

A spacer assembly 618 maintains a predetermined separation between the sliding contacts 620 and 630. The illustrated spacer assembly 618 maintains a fixed separation between the sliding contacts 620 and 630, measured in the direction of motion of the sliding contacts 620 and 630. The resistivity of the graded resistance block may be graded such that the resistance between the sliding contacts 620 and 630 is very small when the spacer assembly 618 is closest to a low electrical resistivity end 612. The resistance may then gradually increase as the spacer assembly 618 moves away from the end 612 towards an end 614 that exhibits an electrical resistivity higher than the end 612. The resistance between the sliding contacts 620 and 630 reaches a maximum value when the spacer assembly 618 is closest to the end 614. In one embodiment, the electrical resistivity at the end 614 is up to 12 orders of magnitude greater than the electrical resistivity at end 612. For instance, the electrical resistivity at the end 612 may be 100 micro ohm meter, and at the end 614 may be 1 ohm meter. Alternatively, the electrical resistivity at the end 614 may be over 12 orders of magnitude greater than the electrical resistivity at end 612.

Other spacer assemblies are also envisioned. For example, one spacer assembly may continuously increase the separation while switching off, thus gradually increasing the resistance between the sliding contacts 620 and 630. The spacer assembly may continuously decrease the separation while switching on, thus gradually decreasing the resistance between the sliding contacts 620 and 630. Such a spacer assembly may be realized, for example, using a lever having pins at different distances from the fulcrum, each pin driving a sliding contact in a translating motion along the sliding surface 616.

Figure 7:
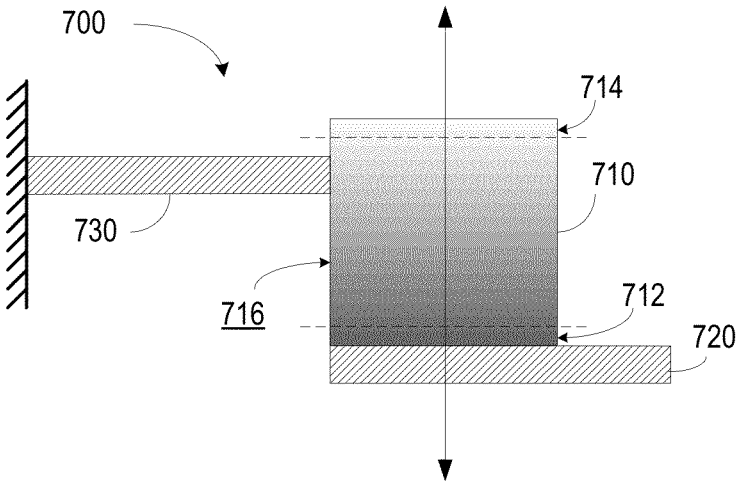
FIG. 7 illustrates a simplified schematic of an electrical switch, according to another embodiment.

FIG. 7 illustrates yet another embodiment of an electrical switch. FIG. 7 is a simplified schematic of an electrical switch 700. The electrical switch 700 includes a graded resistance block 710. The graded resistance block 710 includes an end 712 having a low electrical resistivity, and an end 714 having an electrical resistivity higher than the electrical resistivity of end 712. The electrical resistivity at the end 714 is up to 12 orders of magnitude greater than the electrical resistivity at end 712. For instance, the electrical resistivity at the end 712 may be 100 micro ohm meter, and at the end 714 may be 1 ohm meter. Alternatively, the electrical resistivity at the end 714 may be over 12 orders of magnitude greater than the electrical resistivity at end 712. The graded resistance block 710 also includes a sliding surface 716.

The electrical switch 700 further includes a contact 720 fixedly electrically coupled to the end 712 of the graded resistance block 710. Another contact 730 may be fixedly coupled to a housing (not shown) of the electrical switch 700. The graded resistance block 710 and the contact 720 are configured to slide in relation to the contact 730, in the direction of the double headed arrow illustrated in FIG. 7. In other words, the graded resistance block 710 is slidably coupled to the contact 730, and fixedly coupled to the contact 720. In a closed circuit position, the graded resistance block 710 may be positioned such that the current path between the contact 720 and the contact 730 encounters minimum possible resistance. For example, the contact 730 may be in direct contact with contact 720, or the end 712. During a switch opening operation, the graded resistance block 710 may slide downward, such that the current path between the contact 720 and the contact 730 encounters maximum resistance. For example, the contact 730 may be in direct contact with the end 714. A suitable forcing mechanism (not shown) may be coupled to the graded resistance block 710, or the contact 720, or an assembly on which the two are mounted. The forcing mechanism is configured to slide the graded resistance block 710 over the contact 730. The forcing mechanism may be a spring actuated mechanism. Alternatively, the forcing mechanism may be a manually operated mechanism, such as, but not limited to, a plunger mechanism, a lever mechanism, and so forth.

Figure 8:
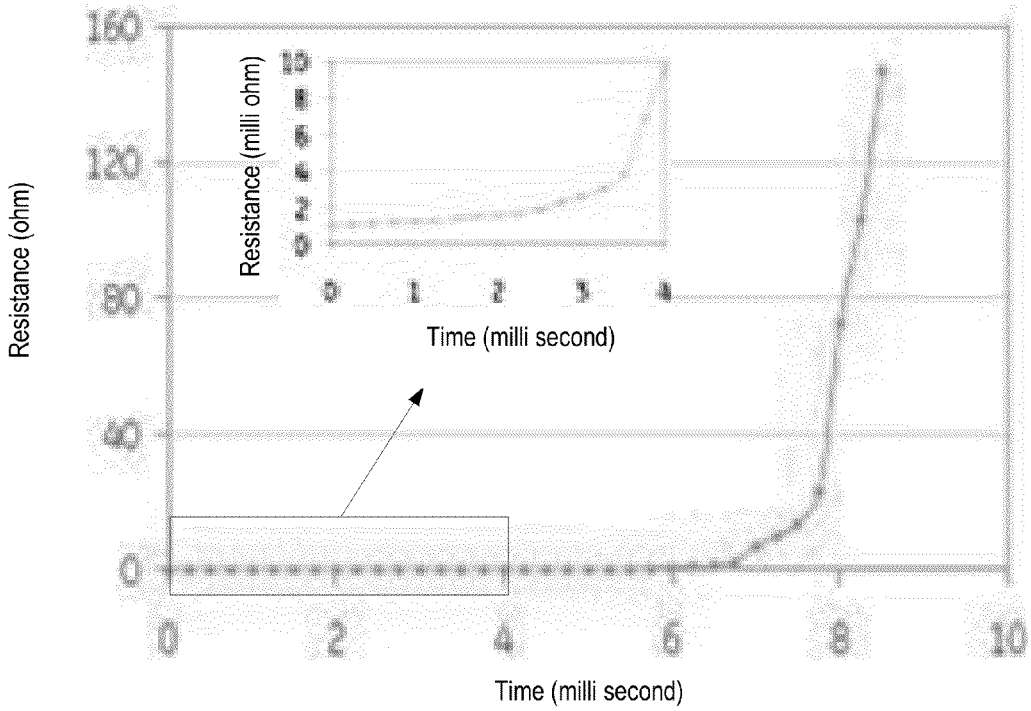
FIG. 8 is a graph of electrical parameters versus the switching time, according to one embodiment.

FIG. 8 illustrates a graph of resistance versus the switching time, according to one embodiment. The variable resistance parameter of graded resistance block is depicted on vertical axis in Ohmic (Ω) unit, while switching time of electrical switch is depicted on horizontal axis in milli second (msec) unit. The graph shows a near exponential growth of resistance over the switching time. According to one embodiment, the resistance of the graded resistance block is a combined linear and exponential function of switching time. The mathematical representation of resistance (R) over the switching time (T) can be depicted as $R=a\cdot T+b^T$ where a and b are real numbers. The graph of resistance over the switching time can also exhibit other mathematical functions including, but not limited to, parabolic, exponential, linear and step function.

Figure 9:
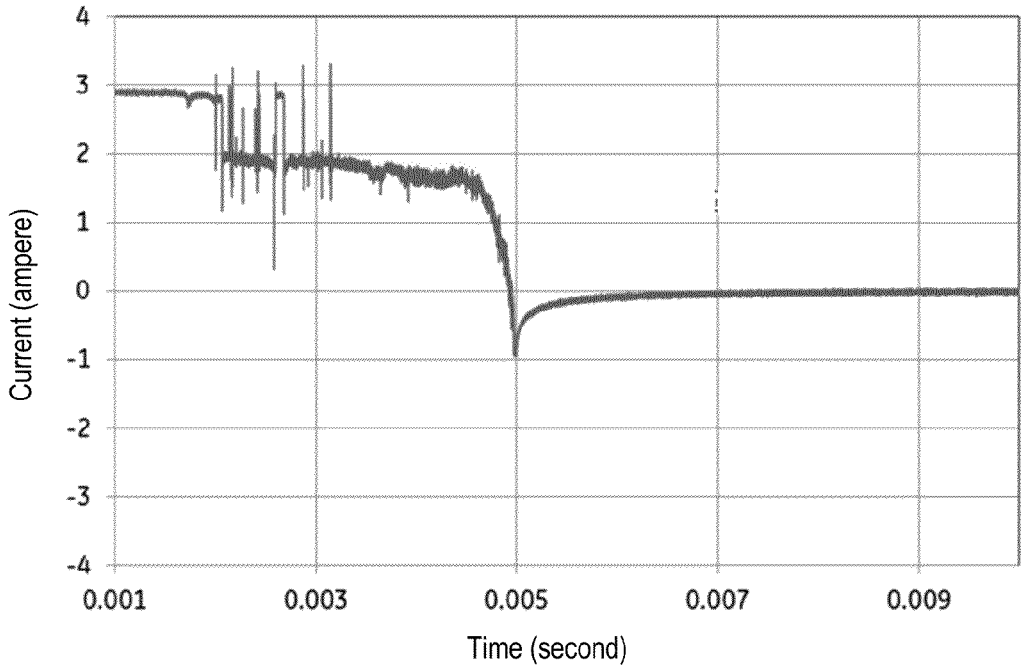
FIG. 9 is a graph of current flowing through the electrical switch versus the switching time, according to one embodiment.

FIG. 9 illustrates the flow of current through an electrical switch over the switching time, according to one embodiment. The electrical switch may exhibit chatter during opening of closed contacts or closing of open contacts, in the absence of sufficient damping or sufficient inertia of the sliding contact assembly. Chatter is a rapidly pulsed electric current instead of a clean transition from closed circuit to open circuit. Chatter typically occurs due to low stiffness springs disposed on the sliding contact to maintain contact pressure, which cause bouncing of the sliding contact. In FIG. 9, the current is plotted on vertical axis in Ampere (amp) unit and switching time is plotted on horizontal axis in second unit. As shown in FIG. 9, the conventional electrical switch produces a rapidly pulsed current during time period 0.001 second and 0.003 second. The amount of chatter is dependent on the design of the electrical switch. The closing/opening velocity of the switching contacts, the initial contact force, the mass of the switching contacts and mechanical resonances in the electrical switch system, all have an impact on the amount of chatter that is generated during contact closure/opening. The chatter may result in shortening the life of the switch contacts because of excessive contact bounce.

Figure 10:
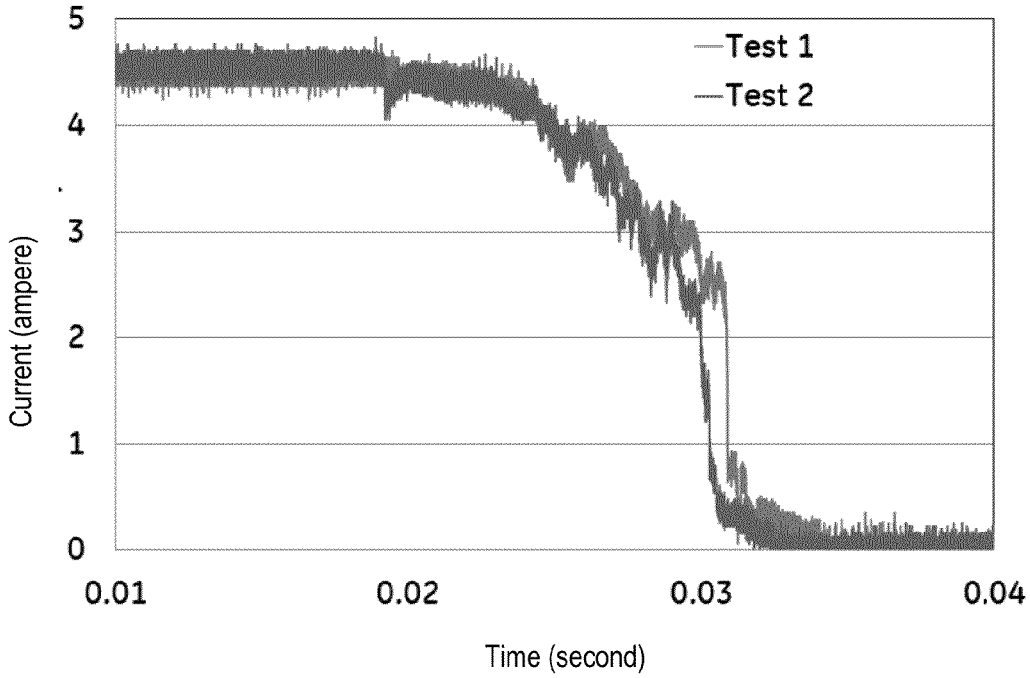
FIG. 10 is a graph of current flowing through the electrical switch versus the switching time, according to another embodiment.

In various embodiments presented herein, the spring assembly for maintaining contact pressure may be disposed on the graded resistance block. Such an arrangement may provide a high inertia system, thus improving damping against contact bounce. Stiffer springs may be employed to further enhance the damping. Damping blocks or ballast may also be fixed to the sliding contact, to further increase inertia and improve damping. FIG. 10 illustrates the flow of current over the switching time, through the electrical switch according to one embodiment. In FIG. 10, the current is plotted on vertical axis in Ampere (amp) and the switching time is plotted on horizontal axis in second. In comparison to FIG. 9, the graph in FIG. 10 represents a cleaner current flow during the switching operation, indicating substantially reduced chatter.

There are various technical and commercial advantages associated with embodiments presented herein. For instance, electrical switches and circuit breakers described herein work for AC as well as DC loads. The circuit breakers described herein have a faster fault clearing time of less than 10 milli seconds in comparison to 15-20 milli second fault clearing time of a conventional design. Also, the use of a graded resistance block to gradually reduce current may substantially reduce or completely eliminated electrical arcing during switching. The performance measurement of the circuit breaker can be measured in terms of "let-through" energy having units $kA^2$ Sec. The let-through energy indicates the amount of energy that is received downstream from the circuit breaker in the event of a fault condition. Excess let-through energy is undesirable and hence needs to be reduced. The circuit breakers described herein have a let-through energy of approximately $1e^6$ $A^2$ s in comparison to nearly $3e^6$ $A^2$ s of a conventional circuit breaker. Such reduction in let-through energy may significantly improve the service life of the circuit breaker over a conventional circuit breaker.

The invention claimed is:

1. An electrical switch comprising:

a graded resistance block comprising a first end having a first electrical resistivity and a second end having an electrical resistivity greater than the first electrical resistivity;

a fixed contact electrically coupled to the first end of the graded resistance block;

a sliding contact configured to slide over the graded resistance block; and a forcing, mechanism configured to slide the sliding contact over the graded resistance block from the first end to the second end;

wherein the graded resistance block further comprises an arc shaped sliding surface, and the forcing mechanism comprises a rotary assembly configured to slide the sliding contact along the arc shaped sliding surface.

2. The electrical switch of claim 1, wherein electrical resistivity of the graded resistance block varies by up to 12 orders of magnitude between the first end and the second end.

3. The electrical switch of claim 1 wherein electrical resistivity of the graded resistance block varies from 1-10 micro Ohm meter at the first end to 1-10 Ohm meter at the second end.

4. The electrical switch of claim 1, wherein the graded resistance block comprises a plurality of resistance cassettes disposed end to end, wherein each of the plurality of resistance cassettes have a distinct electrical resistivity.

5. The electrical switch of claim 1, wherein the graded resistance block comprises a ceramic monolithic cassette comprising aluminum oxide, zinc oxide, barium titanate, silver, molybdenum or combinations thereof.

6. The electrical switch of claim 1, wherein the graded resistance block comprises a conjugated polymer cassette.

7. The electrical switch of claim 1, wherein:

the graded resistance block comprises a planar sliding surface; and the forcing mechanism comprises a translating assembly, to slide the sliding contact along the planar surface.

8. The electrical switch of claim 1 further comprising:

a spring, assembly mechanically coupled to the graded resistance block to exert a normal contact force against the sliding contact.

9. The electrical switch of claim 1 further comprising:

a spring assembly mechanically coupled to the sliding contact to exert a normal contact force against the graded resistance block.

10. An electrical switch comprising:

a first contact;

a graded resistance block slidably coupled to the first contact and comprising a first end having a first electrical resistivity and a second end having an electrical resistivity greater than the first electrical resistivity;

a second contact electrically coupled to the first end of the graded resistance block;

a forcing mechanism to slide the graded resistance block across the first contact such that a current path between the first and second contacts transitions from a conducting state to a non-conducting state.

11. The electrical switch of claim 10, wherein electrical resistivity of the graded resistance block varies by up to 12 orders of magnitude between the first end and the second end.

12. The electrical switch of claim 10, wherein electrical resistivity of the graded resistance block, varies from 1-10 micro Ohm meter at the first end to 1-10 Ohm meter at the second end.

13. The electrical switch of claim 10, wherein the graded resistance block comprises a plurality of resistance cassettes disposed end to end, wherein each of the plurality of resistance cassettes have a distinct electrical resistivity.

14. The electrical switch of claim 10, wherein the graded resistance block comprises a ceramic monolithic cassette comprising aluminum oxide, zinc oxide, barium titanate, silver, molybdenum or combinations thereof.

15. The electrical switch of claim 10, wherein the graded resistance block comprises a conjugated polymer cassette.

16. The electrical switch of claim 10, wherein:

the graded resistance block comprises an arc shaped sliding surface; and the forcing mechanism comprises a rotary assembly configured to slide the arc shaped sliding surface over the first contact.

17. The electrical switch of claim 10, wherein:

the graded resistance block comprises a planar sliding surface; and the forcing mechanism comprises a translating assembly to slide the planar surface over the first contact.

18. The electrical switch of claim 10 further comprising:

a spring assembly mechanically coupled to the graded resistance block to exert a normal contact force against the first contact.

19. The electrical switch of claim 10 further comprising:

a spring assembly mechanically coupled to the first contact to exert a normal contact force against the graded resistance block.

20. An electrical switch comprising:

a graded resistance block comprising a first end having a first electrical resistivity and a second end having an electrical resistivity greater than the first electrical resistivity;

a first sliding contact configured to slide over the graded resistance block; and a second sliding contact configured to slide over the graded resistance block, wherein the first sliding contact and the second sliding contact are configured to contact the graded resistance block at a predetermined separation measured in a direction of motion of the first sliding contact and the second sliding contact.

21. The electrical switch of claim 20, wherein the predetermined separation is a fixed separation.

22. The electrical switch of claim 20, wherein the predetermined separation is a continuously varying separation.

23. The electrical switch of claim 20, wherein the graded resistance block comprises a ceramic monolithic cassette comprising aluminum oxide, zinc oxide, barium titanate, silver, molybdenum or combinations thereof.

24. The electrical switch of claim 20, wherein the graded resistance block comprises a conjugated polymer cassette.

* * * * *

UNITED STATES PATENT AND TRADEMARK OFFICE

CERTIFICATE OF CORRECTION

PATENT NO. : 8,773,235 B2
APPLICATION NO. : 13/677905
DATED : July 8, 2014
INVENTOR(S) : Bohori et al.

It is certified that error appears in the above-identified patent and that said Letters Patent is hereby corrected as shown below:

In the Claims

In Column 10, Line 16, in Claim 1, delete “forcing, mechanism” and insert -- forcing mechanism --, therefor.

In Column 11, Line 2, in Claim 12, delete “block, varies” and insert -- block varies --, therefor.

Signed and Sealed this
Eleventh Day of November, 2014

Michelle K. Lee

Michelle K. Lee
*Deputy Director of the United States Patent and Trademark Office*